US005248048A

United States Patent [19]

Dore

[11] Patent Number: 5,248,048

[45] Date of Patent: Sep. 28, 1993

[54] VARIETAL WINE SELLING/MERCHANDISING HOLDER

[76] Inventor: J. Patrick Dore, 67 Oak Springs Dr., San Anselmo, Calif. 94960

[21] Appl. No.: 959,037

[22] Filed: Oct. 8, 1992

[51] Int. Cl.[5] ..... A47F 5/00

[52] U.S. Cl. ..... 211/74; 211/4; 211/189

[58] Field of Search ..... 211/74, 126, 189, 4

[56] References Cited

U.S. PATENT DOCUMENTS

| | | | |
|---|---|---|---|
| 19,438 | 11/1889 | Lawson | 211/74 |
| Re. 168,713 | 1/1953 | Rubin | 211/74 X |
| 284,499 | 9/1883 | Smith | 211/74 |
| 375,413 | 12/1887 | Cummings | 211/74 |
| 4,660,727 | 4/1987 | Levine | 211/74 |
| 5,025,936 | 6/1991 | Lamoureaux | 211/74 |

*Primary Examiner*—Alvin C. Chin-Shue
*Assistant Examiner*—Sarah A. Lechok
*Attorney, Agent, or Firm*—Phillips, Moore, Lempio & Finley

[57] ABSTRACT

A merchandiser-holder (10) is adapted to display at least one wine bottle (11) to customers on a table in a restaurant or the like. The holder (10) comprises a base plate (12) having a centrally disposed post (17) secured thereon and a retaining plate (15) is spaced above the base plate and mounted on the post. An extension (23) of the post functions as a fastener to releasably secure the retaining plate (15) on the post (17) and the wine bottle (11) in the holder.

11 Claims, 2 Drawing Sheets

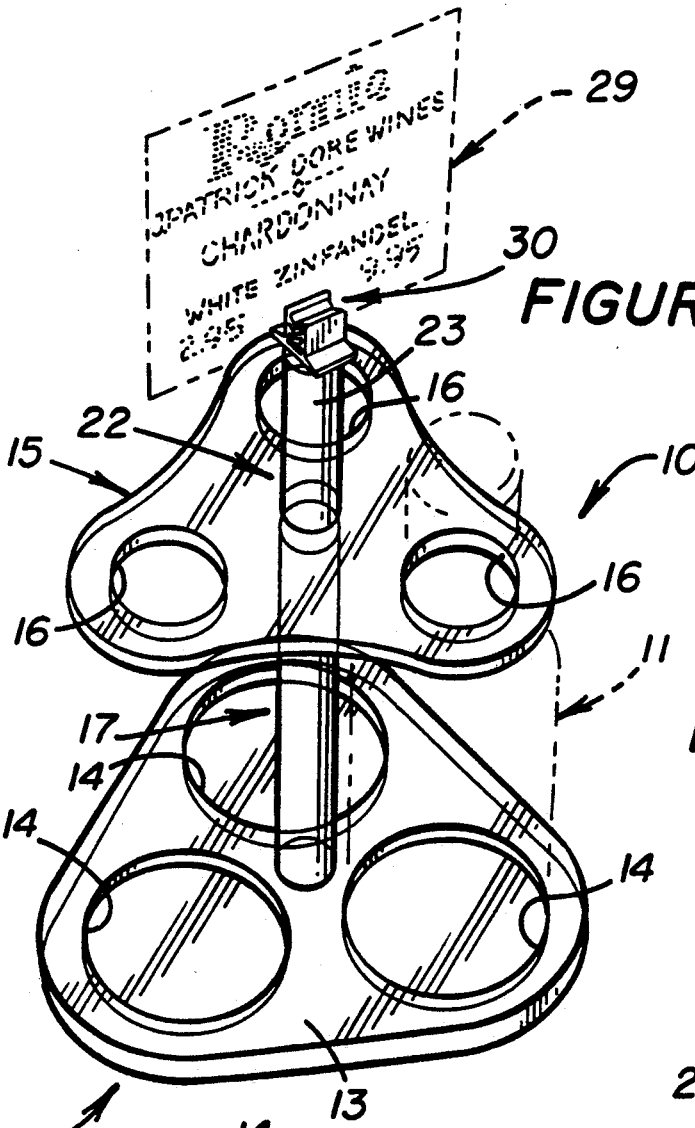
FIGURE 1
FIGURE 2
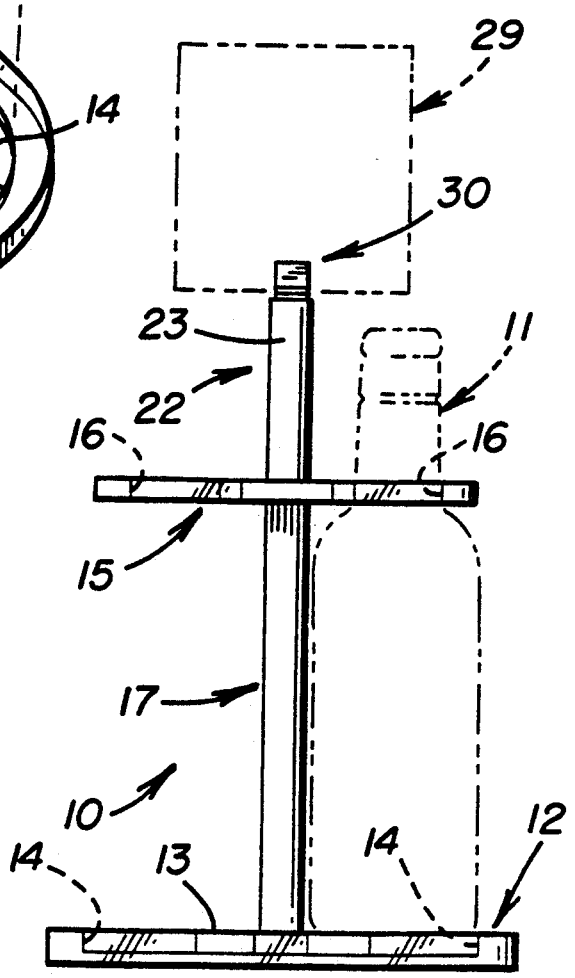
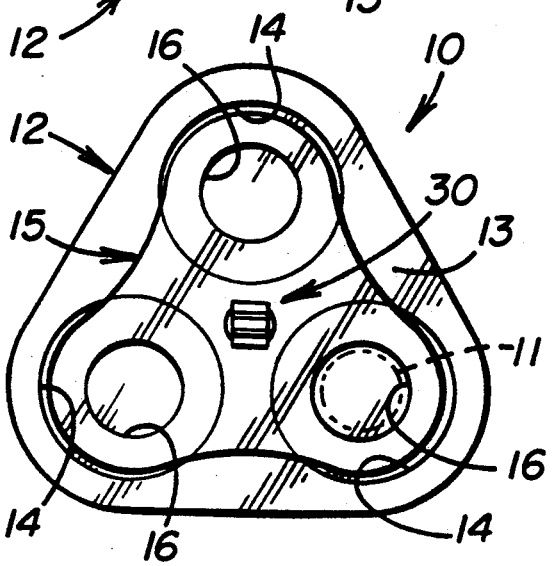
FIGURE 3

VARIETAL WINE SELLING/MERCHANDISING HOLDER

TECHNICAL FIELD

This invention relates to a multi-bottle holder and more particularly to a selling/merchandising holder adapted to releasably retain and display wine bottles to customers in a restaurant or the like.

BACKGROUND ART

Restaurants continuously seek new methods and displays for promoting the sale of wines to their customers. Since a customer seldom orders wine by brand name, the customer normally relies on a waiter or other server of wines for ordering a particular wine to compliment the customer's meal. Oftentimes, the waiter is reluctant or unable to suggest a wine, primarily due to the multiple brands and varietals available in the restaurant's wine cellar and/or the waiter's dearth of knowledge regarding wines.

Some restaurants attempt to promote their wines by placing brief descriptions of particular wines on their wine lists. Other restaurants place placards or "table tents" on the table to advertise various brands and varietals of wine. Some restaurants even place a full bottle of a particular wine on a diner's table in the hope that such wine will be ordered with the diner's meal.

DISCLOSURE OF INVENTION

An object of this invention is to provide an economical and attractive holder adapted to hold and display at least one bottle of wine to customers in a restaurant or the like to promote the wine's sale to a customer directly.

The holder comprises a horizontally disposed base plate defining an upper surface adapted to support a bottom of the wine bottle thereon. A horizontally disposed retaining plate is spaced vertically above the base plate in parallel relationship therewith and defines at least one opening therethrough for receiving a neck of the wine bottle therein. A vertically disposed post releasably attaches the retaining plate to the base plate to hold the retaining plate in its vertically spaced position above the base plate and to hold the wine bottle in a vertically disposed, fixed position within the holder.

In the hereinafter described preferred embodiment of this invention, the holder is adapted to hold and retain three circumferentially spaced wine bottles thereon. For example, each of the wine bottles can constitute the 187 ml size and contain varieties of wines, such as a chardonnay, cabernet sauvignon and white zinfandel. These three wines collectively represent approximately 97% of varietal wine consumption.

BRIEF DESCRIPTION OF THE DRAWINGS

Other advantages and objectives of this invention will become apparent from the following description and accompanying drawings wherein:

FIG. 1 is a perspective view illustrating a varietal wine merchandiser-holder embodiment of this invention;

FIG. 2 is a side elevational view of the holder;

FIG. 3 is top plan view of the holder;

BEST MODE OF CARRYING OUT THE INVENTION

Figure 5:
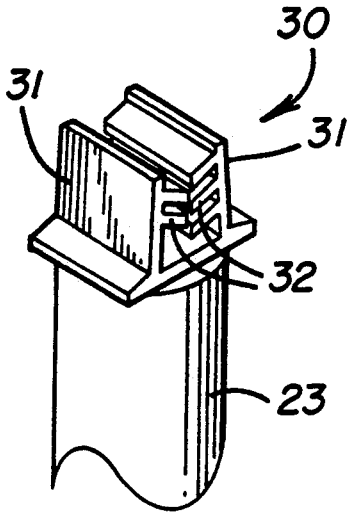
FIG. 5 is an enlarged isometric view illustrating a header card retaining means.

FIG. 1 illustrates a varietal wine merchandiser-holder 10 adapted to display at least one wine bottle 11 to customers in a restaurant or the like. The holder is adapted to be placed on a table in a restaurant and is preferably designed to hold three separate wine bottles of the 187 ml size to visually suggest purchase by the customers. For example, the wine bottles can respectively contain chardonnay, cabernet sauvignon and white zinfandel which collectively represent approximately 97% of all varietal wine consumption in a restaurant.

Holder 10 comprises a horizontally disposed base plate 12 defining an upper surface 13, adapted to support the bottom of wine bottle 11 thereon. In the embodiment illustrated, three circumferentially spaced circular recesses 14 are defined in upper surface 13 and are suitably sized to each snugly to receive the bottom of a respective wine bottle therein and to restrain laterally movement or removal thereof.

Three circumferentially spaced circular openings 16 (FIG. 3) are formed through the retainer plate and are sized for snugly receiving the necks of the wine bottles therein. As shown in FIG. 2, the bottom surface of the retaining plate is positioned in close proximity to the body of each wine bottle, at its juncture with the neck of the bottle, to fix the wine bottle in a vertical position and to prevent removal thereof. As described hereinafter, retaining plate 15 is adapted to be detached from a post 17 for removal or replacement of one or more of the wine bottles.

Figure 4:
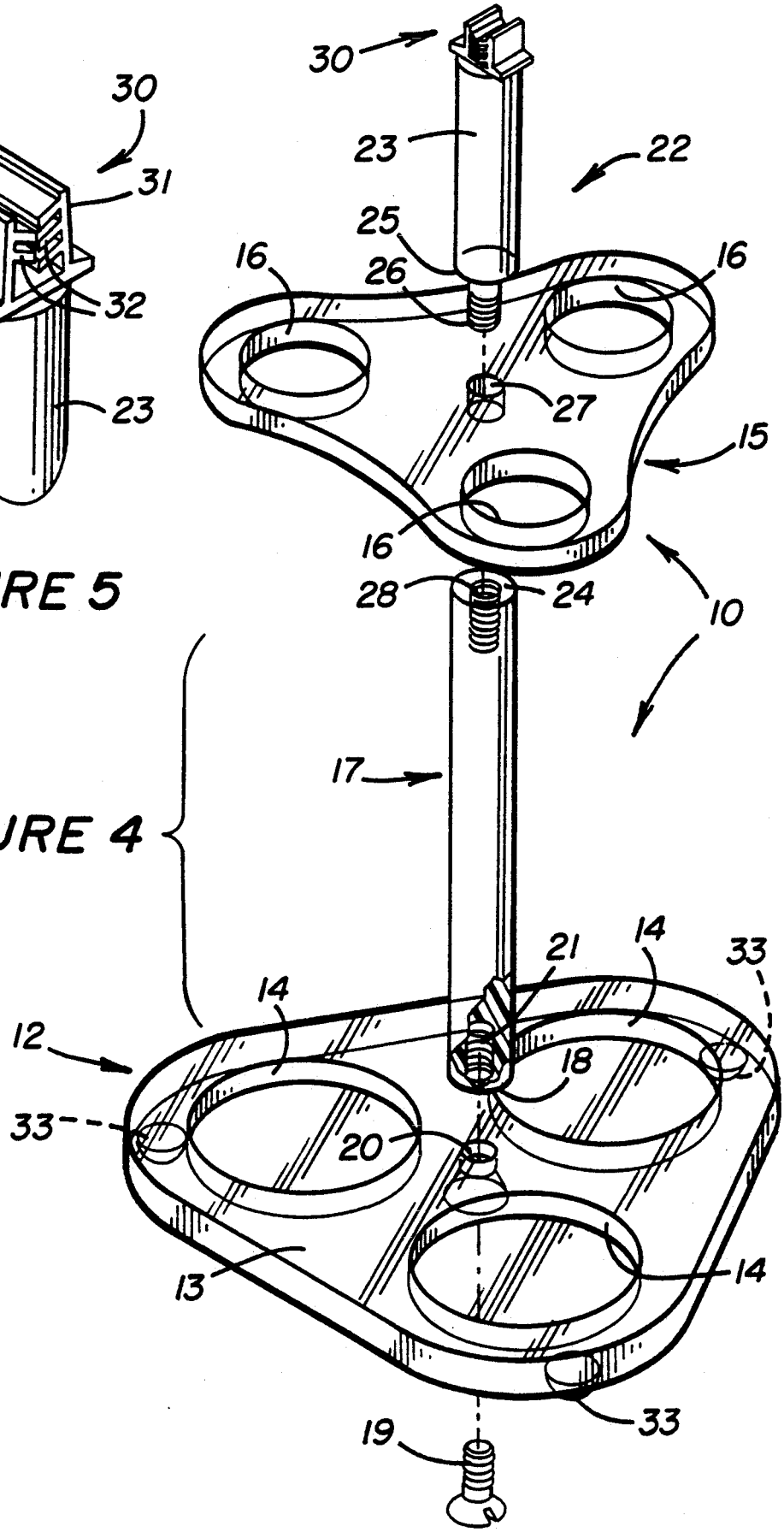
FIG. 4 is an exploded isometric view of the holder.

Vertically disposed post 17, disposed on a central longitudinal axis of holder 10, functions to releasably attach retaining plate 15 to base 12 to hold the retaining plate in its vertically spaced position above the base plate and to hold each wine bottle in a vertically disposed fixed position within the holder. It should be noted that each opening 16 is disposed in vertical alignment with a respective recess 14, formed in base plate 12. A bearing surface 18 is defined on the lower, distal end of post 17 to engage upper surface 13 of base plate 12. A recessed screw 19 (FIG. 4) extends through a hole 20, formed through the base plate, and is threaded to screw threads 21 formed in the lower end of the post.

A fastening means 22, including a detachable post extension 23, releasably secures retaining plate 15 on an upper end of post 17. In particular, retaining plate 15 is disposed between an annular bearing surface 24, formed on an upper end of post 17, and a bearing surface 25, formed on a lower end of post extension 23. The fastening means further includes a screw stem 26 secured centrally on the lower end of extension 23 that extends through a hole 27, formed centrally through the retaining plate, and threadably engages within screw threads 28 formed in the upper end of post 17.

Thus, when retaining plate 15 is mounted on post 17, and post extension 23 is screwed-down by screw stem 26, the retaining plate will be clamped between the post and post extension. The bottom of a wine bottle 11 (FIG. 1) is placed in each recess 14 (FIG. 4) prior to the placement of the necks of the bottles within openings 16 and the clamping of the retaining plate to the post. The wine bottles are now locked into the holder to prevent removal of the wine bottles therefrom.

As further shown in FIGS. 1 and 5, a header card 29 is preferably mounted on the upper end of post extension 23 by the illustrated card retaining means 30. The header card may include printed information, such as a restaurant's name, a producer or vintage, wine types, bottle size, selling price, etc. In the embodiment illustrated, the card retaining means comprises a snap-action clamp 39 for pinching and holding opposite sides of header card 29 on the upper end of the post extension. As shown in FIG. 5, card retaining means 30 may comprise a pair of upstanding sidewalls 31 each having a plurality of vertically spaced flexible fingers 32 secured thereon. The fingers project downwardly toward each other to provide a one-way snap-action locking function to permit the header card to be pushed in to the card retaining means, but to prevent easy removal thereof.

The component parts of holder 10 may be composed of any suitable material, such as transparent acrylic plastic material. The holder could be configured, as desired, to hold one or any other chosen number of wine bottles. In the preferred embodiment, base plate 12 and retaining plate 15 are each formed with an at least generally triangular configuration with an opening 16 being formed at each apex of the generally triangular retaining plate. Openings 16 and recesses 14 are preferably circumferentially disposed and equally spaced about the symmetrically formed holder, as shown. If so desired, a plurality of circumferentially spaced foot rests 33 (FIG. 4) can be secured beneath base plate 12 or molded integrally therewith.

As suggested above, the three-bottle holder is particularly adapted to display bottles of the 187 ml size. Since chardonnay, cabernet sauvignon and white zinfandel represent approximately 97% of all varietal consumption, these three bottles of wine are particularly adapted for use with the above described three-bottle holder.

I claim:

1. A holder adapted to display at least one wine bottle said wine bottle having a body portion and a reduced diameter neck portion, said holder comprising a horizontally disposed base plate defining an upper surface adapted to support a bottom of said wine bottle thereon, a horizontally disposed retaining plate spaced vertically above said base plate in parallel relationship therewith and defining at least one opening means therethrough for only receiving said neck portion therein, with the vertical distance between an underside of said retaining plate and an upper side of said base plate being sized to snugly lock said body portion of said wine bottle therebetween to prevent removal of said wine bottle from said holder without first removing said retaining plate therefrom and vertically disposed post means for releasably attaching said retaining plate to said base plate to hold said retaining plate in its vertically spaced position above said base plate and to hold said wine bottle in a vertically disposed fixed and locked position within said holder between said base plate and said retaining plate.

2. The holder of claim 1 wherein said base plate has at least one circular recess means defined in the upper surface thereof and disposed in vertical alignment with said opening means for receiving the bottom of said wine bottle therein and for restraining lateral movement thereof relative to said base plate.

3. The holder of claim 1 wherein said post means comprises a vertically disposed post having a lower end secured to said base plate and fastening means for releasably securing said retaining plate on an upper end of said post.

4. The holder of claim 3 wherein said fastening means comprises an extension of said post.

5. The holder of said claim 4 wherein said retaining plate is disposed between an upper end of said post and a lower end of said extension and said fastening means threadably secures said extension to said post for clamping said retaining plate therebetween.

6. The holder of claim 4 further comprising card retaining means for releasably attaching a header card to an upper end of said extension.

7. The holder of claim 6 wherein said card retaining means comprises snap-action clamp means for pinching and holding opposite sides of said header card on the upper end of said extension.

8. The holder of claim 1 wherein said base plate and said retaining plate are each composed of a transparent plastic material.

9. The holder of claim 1 wherein said post means is disposed on a centrally and vertically disposed axis of said holder and a plurality of said opening means are formed through said retaining plate and are circumferentially and symmetrically disposed about said axis.

10. The holder of claim 1 wherein three of said opening means are formed through said retaining plate.

11. The holder of claim 10 wherein each of said base and retaining plates are at least generally triangular and wherein a said opening means is formed closely adjacent to each apex of said retaining plate.

* * * * *